US005119873A

United States Patent [19]

Yokoyama

[11] Patent Number: 5,119,873

[45] Date of Patent: Jun. 9, 1992

[54] WASTE SHOT CONTROL FOR A DIE CASTING MACHINE

[75] Inventor: Hiroshi Yokoyama, Kanagawa, Japan

[73] Assignee: Toshiba Kikai Kabushiki Kaisha, Tokyo, Japan

[21] Appl. No.: 645,831

[22] Filed: Jan. 25, 1991

[30] Foreign Application Priority Data

Jan. 25, 1990 [JP] Japan ..... 2-13535

[51] Int. Cl.[5] ..... B22D 17/32

[52] U.S. Cl. ..... 164/4.1; 164/154

[58] Field of Search ..... 164/154, 155, 457, 4.1; 425/135, 136; 264/40.1

[56] References Cited

FOREIGN PATENT DOCUMENTS 3329705 3/1985 Fed. Rep. of Germany ..... 164/155

*Primary Examiner*—Kuang Y. Lin

*Attorney, Agent, or Firm*—Cushman, Darby & Cushman

[57] ABSTRACT

An arrangement for controlling a waste shot of a die casting machine. Data are entered and stored in a memory·data defining waste shot mode and normal shot mode operations of the die casting machine. The machine is then operated in normal shot mode. By monitoring various parameters, it is determined whether the die casting machine is operating in accordance with the data defining normal shot mode operation. In the event that the die casting machine is not operating in accordance with the data defining normal shot mode operation, the machine is stopped. After stopping, the die casting machine is restarted and automatically operated in waste shot mode in accordance with data previously stored, and then automatically operated in normal shot mode in accordance with data previously stored.

18 Claims, 5 Drawing Sheets

| | | |
|---|---|---|
| PATTERN NO. | 1 | |
| NUMBER OF WASTE SHOTS | 4 | |
| LOW SPEED INJECTION | **ON** | OFF |
| HIGH SPEED INJECTION | ON | **OFF** |
| INTENSIFICATION PROCESS | ON | **OFF** |

FIGURE 4

| | | |
|---|---|---|
| PATTERN NO. | 2 | |
| NUMBER OF WASTE SHOTS | 5 | |
| LOW SPEED INJECTION | ON | **OFF** |
| HIGH SPEED INJECTION | **ON** | OFF |
| INTENSIFICATION PROCESS | ON | **OFF** |

FIGURE 5

| | | |
|---|---|---|
| PATTERN NO. | 3 | |
| NUMBER OF WASTE SHOTS | 3 | |
| LOW SPEED INJECTION SPEED VALUE | ON<br>200 | OFF<br>mm/sec |
| HIGH SPEED INJECTION SPEED VALUE | ON<br>000 | OFF<br>mm/sec |
| INTENSIFICATION PROCESS SPEED VALUE | ON<br>000 | OFF<br>kg/cm$^2$ |

FIGURE 6

WASTE SHOT CONTROL FOR A DIE CASTING MACHINE

BACKGROUND OF THE INVENTION

1. Field of the Invention

This invention relates in general to controlling die casting machines. More specifically, this invention relates to controlling a waste shot of a die casting machine, particularly after the machine has been stopped or paused, and upon initial start up of the machine.

2. Description of the Related Art

Die casting machines generally operate in three different modes. These different modes of operation include: "trial shot mode", "waste shot mode" and "normal shot mode".

Normal shot mode: Normal shot mode refers to the normal continuous operation of a die casting machine during which operation it is manufacturing die cast products (as long as the machine is operating normally).

Trial shot mode: A die casting machine is operated in its trial shot mode before it is operated in its normal shot mode. During trial shot mode, the operator establishes the various operating parameters that will be used during normal shot mode operation.

Waste shot mode: Usually the die casting machine is operated in its waste shot mode during warm up. Waste shot operation is usually carried out when the machine is turned on initially, or after it has been paused for sufficient time for the molds to cool to a temperature below that required for normal mode operation.

Once the parameters of normal operation have been established during one or more trial shots, and the die casting machine has been warmed up and operated with one or more waste shots, it can be operated in normal shot mode in accordance with the parameters determined during test shot mode operation to continuously manufacture products.

During normal shot mode operation, the die casting machine is controlled automatically by a control apparatus of the die casting machine. However, normal mode operation of the die casting machine may be stopped for various reasons. For example, the machine operator may take a lunch break, there may be a need to change a damaged mold or change to a next mold, or there may be some unusual occurrence requiring the die casting machine to be stopped.

When the die casting machine stops, the temperature of its metal mold begins to cool. This cooling will continue until the machine is re-started. Accordingly upon re-start of the machine, the operator of the die casting machine must again operate the machine in waste shot mode before he can operate it in normal shot mode.

In known die casting operations, the operator of the die casting machine must re-set operation conditions for waste shot mode operation each time the die casting machine is stopped or paused and the machine is to be operated in waste shot mode. After setting the conditions for waste shot mode operation, the operator then causes the machine to operate in waste shot mode.

Even though the waste shot conditions are already known by the operator, he must manually set them each time before operating the die casting machine in waste shot mode.

Even if the die casting machine is operated automatically, the operator must manually change the operation of the die casting machine from waste shot mode operation to normal shot mode operation. This decreases efficiency.

Moreover, in known die casting arrangements, the die casting machine is sometimes operated in waste shot mode when it is not necessary to do so. Naturally, this reduces efficiency.

Accordingly, it is desirable to provide for more automatic control of a waste shot mode operation of die casting machines It is advantageous to automatically recognize predetermined conditions that are appropriate for waste shot mode operation and to control the die casting machine so as to automatically operate in accordance with those conditions.

SUMMARY OF THE INVENTION

It is an object of the present invention to provide better control for a die casting machine.

A further object of the invention is to automatically control waste shot mode operation of a die casting machine.

A still further object of the invention is to automatically operate a die casting machine in waste shot mode and then automatically operate it in normal shot mode without the need for manual control by an operator.

It is another object of the present invention to provide a method for controlling a die casting machine, in which a waste shot is automatically carried out without the need for operator intervention.

According to one aspect of the present invention, there is provided an apparatus for controlling waste shot mode operation of a die casting machine. The apparatus includes setting means that an operator can use to input various operating conditions/parameters that control how a waste shot is carried out Memory means store the data input by the operator. Monitoring condition setting means allow for the input of parameters and conditions for monitoring the operation of the die casting machine. These parameters provide a basis for later determining whether or not the die casting machine is operating normally Detecting means are provided for detecting the various operating parameters of the machine Control means are provided for controlling the waste shot based on the various data input by the operator and the various conditions monitored by the detecting means.

According to another aspect of this invention there is provided a method for controlling a waste shot of a die casting machine, comprising the steps of setting a condition for the waste shot and another condition that would indicate some abnormality of the die casting process, detecting a condition of abnormality, generating a signal indicating that the die casting machine should be operated in waste shot mode, and controlling the die casting machine so as to operate in waste shot mode in accordance with the condition for the waste shot mode operation previously set by the operator and stored in memory.

BRIEF DESCRIPTION OF THE DRAWINGS

The invention will be described in further detail with reference to the accompanying drawings in which

FIG. 4 shows an example of a waste shot program used in the embodiment;

FIG. 5 is another example of a waste shot program; and

FIG. 6 shows further example of a waste shot program.

DETAILED DESCRIPTION OF THE PREFERRED EMBODIMENT

Figure 1:
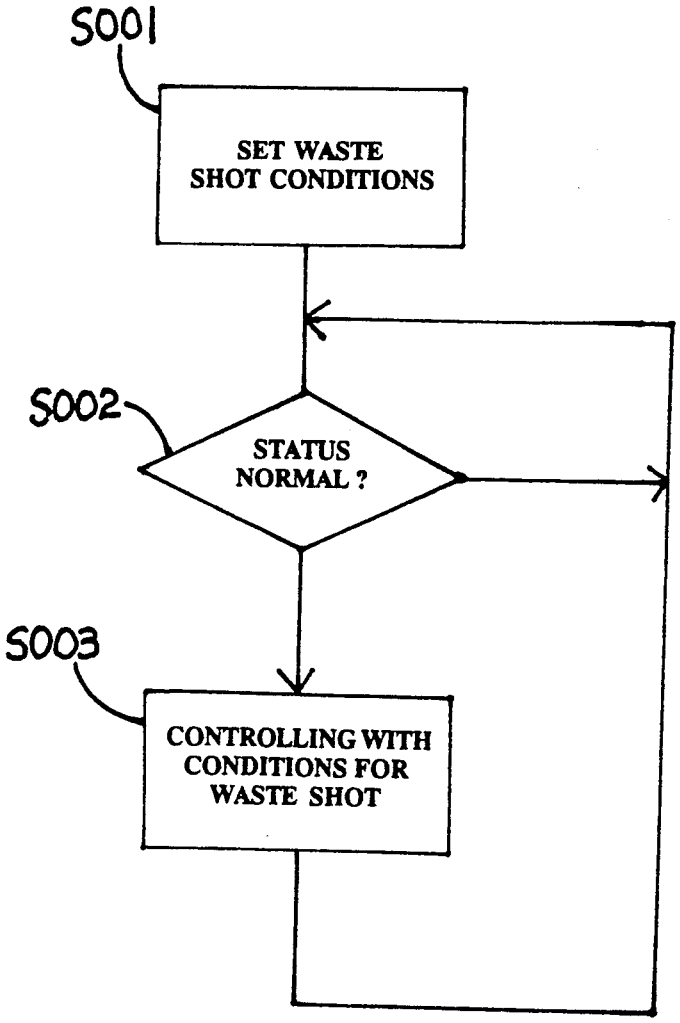
FIG. 1 is a flow chart showing waste shot control for a die casting machine according to the present invention.

Presently preferred embodiments of the present invention will now be described in more detail with reference to the accompanying drawings FIG. 1 is a flow chart showing waste shot control for a die casting machine according to the present invention.

During step S001 conditions are set defining how waste shot mode operation is to be carried out. The conditions may include, for example, the number of waste shots to be carried out, a speed of injection, a pressure of injection, and the like. In other words, the conditions set during this step will be used to control how the die casting machine operates when it is operated in waste shot mode.

During step S002 the status of the die casting machine is monitored during normal mode operation to detect any abnormal operating conditions. Detecting step S002 may include detecting any condition that would indicate abnormal operation of the die casting machine during normal mode operation. One example of an abnormal operating condition might be the temperature of the metal mold. When the temperature of the metal mold is lower than a predetermined level, an abnormality is indicated. Another example would be the cycle time of a single shot during normal mode operation. When the cycle time of a shot exceeds a predetermined level, an abnormality is indicated. If an abnormality is detected at step S002, control passes to step S003.

During step S003 the die casting machine is operated in its waste shot mode based on the conditions set beforehand during setting step S001. When a restart command is issued by the operator (for example, after the die casting machine has been paused), the die casting machine is automatically operated in waste shot mode in accordance with the previously set conditions defining waste shot mode operation. Thereafter the die casting machine is automatically operated in normal shot mode without any intervention by the operator.

Figure 2:
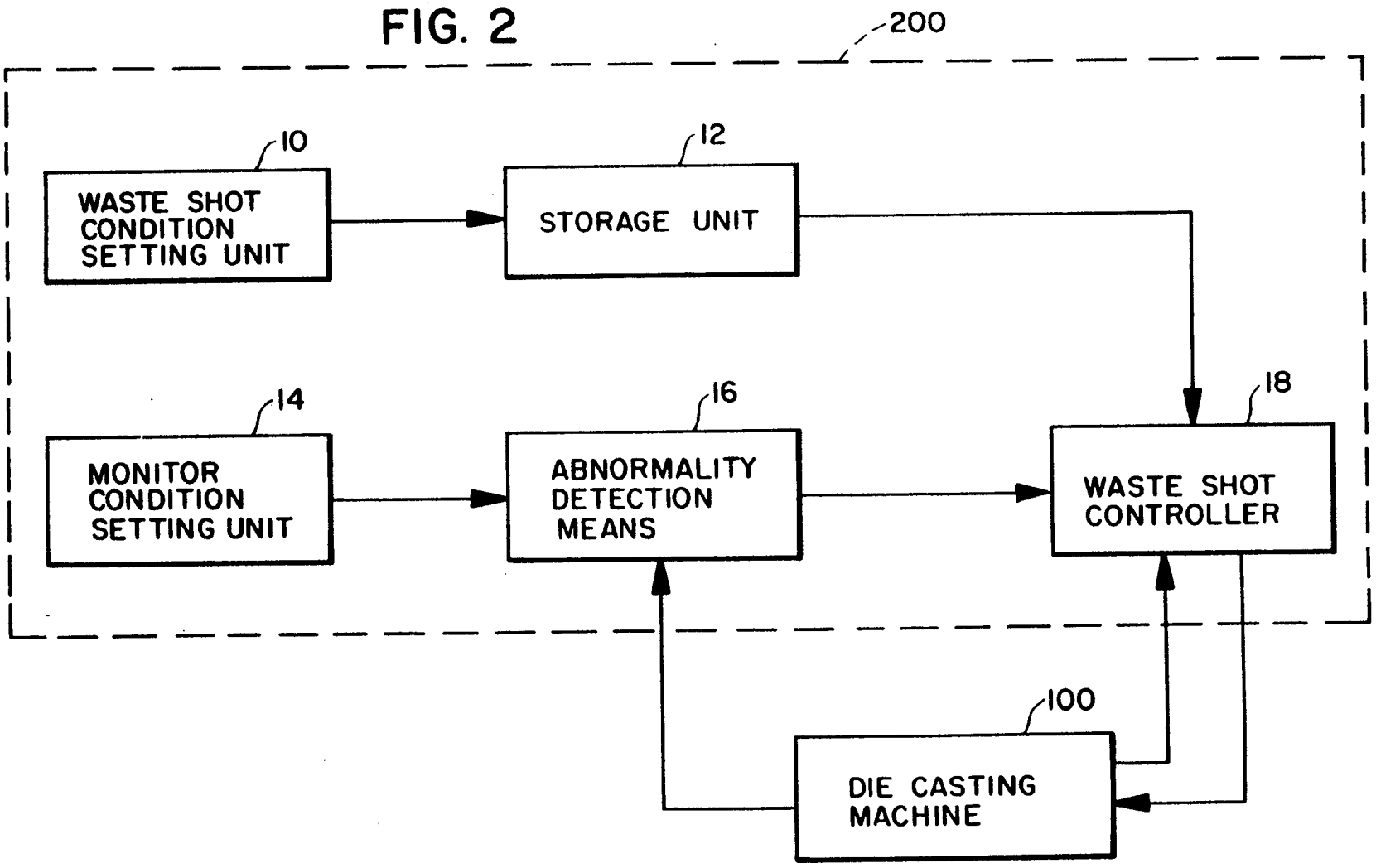
FIG. 2 is a block diagram of an apparatus, according to the present invention, for controlling waste shot operation of a die casting machine.

A waste shot control apparatus, according to the present invention for a die casting machine is shown in FIG. 2.

The apparatus, generally denoted by reference numeral 200, includes a waste shot condition setting unit 10, a storage unit 12, a monitoring condition setting unit 14, an abnormality detector 16 and a waste shot controller 18. Die casting machine 100 is controlled by the waste shot controller 18 of apparatus 200.

Conditions defining how the die casting machine is to operate during waste shot mode operation are set by an operator using setting unit 10. Data entered by the operator are stored in storage unit 12. Monitoring conditions for determining normal/abnormal operation of the die casting machine during normal shot mode operation are entered by the operator using monitor condition setting unit 14. Abnormality detector 16 detects any abnormal status of the die casting machine during normal shot mode operation by comparing current operating conditions with those previously set by using setting unit 14.

When normal shot mode operation is interrupted for some reason and there is a re-start command issued for restarting the die casting machine, waste shot controller 18 responds to the restart command. It causes the die casting machine to operate in waste shot mode in accordance with the conditions previously set by the operator using waste shot condition setting unit 10 (which conditions were stored in storage unit 12).

Figure 3:
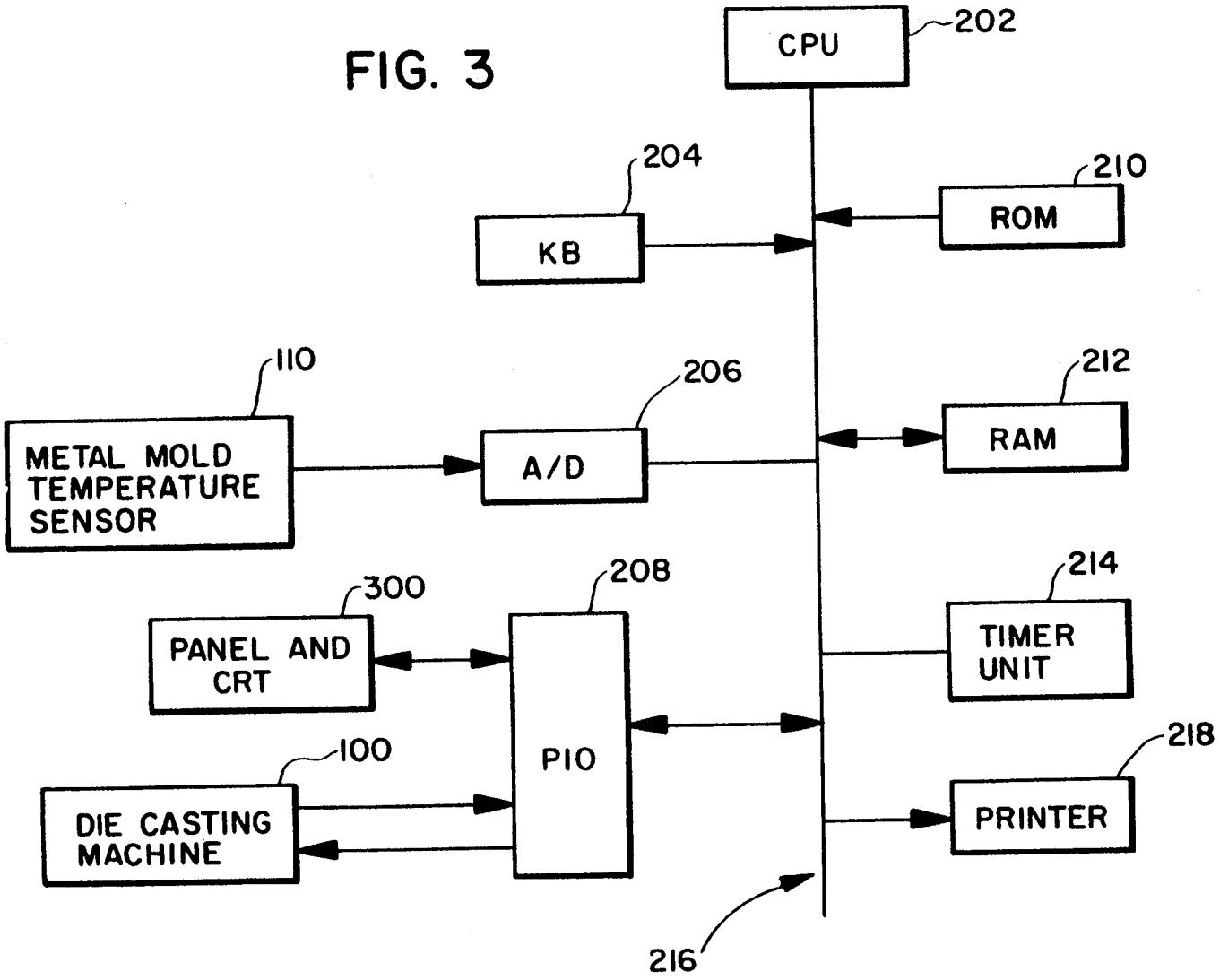
FIG. 3 is a block diagram of an embodiment of a waste shot control apparatus according to the present invention.

A first specific embodiment of waste shot control apparatus 200 is shown in FIG. 3. In this embodiment, waste shot control apparatus 200 is advantageously realized by use of a micro-processor system. The waste shot control apparatus 200 includes a CPU 202, a keyboard (KB) 204, an analog digital convertor (ADC) 206, a process input output unit (PIO) 208, a read only memory (ROM) 210, a random access memory (RAM) 212, a printer 218 and a timer unit 214. The various elements are interconnected via a bus 216 so that CPU 202 can read its program instructions from memory and control the various peripheral components. ROM 210, connected to BUS 216, stores control programs for carrying out the various processes for controlling die casting machine 100. These programs are carried out by CPU 202.

RAM 212 is preferably a semi-conductor memory and is used for storing data set from keyboard 204 and operation panel 300. Keyboard 204 is provided for the operator to set waste shot condition, monitoring conditions and the like. Thus, it provides a physical interface for units 10 and 14.

In this embodiment, one of the conditions monitored during normal shot mode operation is mold temperature. Of course the invention is not limited to monitoring this particular condition, but it provides a simple example for explanatory purposes. Analogue to digital converter (ADC) 206 is connected to metal mold temperature sensor 110 to detect temperature of the metal mold. Other process data from sensors and the like, not shown, may be coupled to ADC 206, and sent to CPU 202 via bus 216 after conversion by ADC 206.

Timer unit 214 includes a pulse generator and is used for judgement of an operation cycle of die casting machine 100. Timer unit 214 continuously interrupts to CPU 202. CPU 202 determines whether the operation cycle of the die casting machine is within prescribed limits based on information received from timer unit 214. Process input output unit 208 is connected to bus 216 and is controlled by CPU 202 to input/output signals from an operation panel 300 and die casting machine 100.

Operation panel 300 displays various indications to the operator such as, for example, "Start", "Stop", "Intensification ON/OFF," "High Speed Injection ON/-OFF," and the like. Operation panel 300 includes a display for displaying a waste shot pattern which is input by the operator of the die casting machine. A CRT display is preferable for displaying the waste shot program pattern, however various alphanumeric display elements may also be used. Various signals from die casting machine 100 are input to PIO 208. These signals are usually derived from limit-switches and the like and indicate to PIO 208 the status of various operating conditions of die casting machine 100. Signals from PIO 208 are coupled to die casting machine 100 to control it. Such control signals may be used to actuate solenoid valves and the like.

The operation of a waste shot control apparatus shown in FIG. 3 is described. One operation cycle of a die casting machine may include several processes. These are, for example, (1) die clamping process
(2) charging process
(3) low speed injection process
(4) high speed injection process
(5) intensify process
(6) die opening process
(7) ejection process
(8) extraction process
(9) spray process Operation cycle time depends on the particular metal mold being used in the die casting machine and it is typically about 30 seconds If die casting machine 100 does not manufacture a predetermined number of a product set and the operation cycle time exceeds the normal operation cycle time, there must be some abnormality in normal shot mode operation. Thus one of the parameters that can be used to judge whether or not die casting machine 100 is operating normally can be the measurement of operation cycle time.

If operation cycle time is a parameter to be used for judging whether or not die casting machine 100 is operating normally, there is stored in ROM 210 a program for detecting the operation cycle time and making the determination. Various normal operation times are stored because the normal operation time is a function of which metal mold is being used, injection pressure, injection speed and the like. The data are input via keyboard 204 and stored in RAM 212 via bus 216. The CPU 202 controls the input of the data for judging the operation cycle time.

CPU 202 sets an abnormal cycle time, for example, 50 seconds at the beginning of the first part of the die clamping process which is described above and counts the operation time using timer unit 214. CPU 202 determines whether die casting machine 100 is operating normally. This judgement is made by CPU 202 comparing input from timer unit 214 to the data stored in RAM 212. When the last "spray process" is finished, CPU 202 resets the timer data, and the next process is started once more again from next die clamping process.

CPU 202 proceeds with the monitoring of operation cycle time. When the operation cycle time exceeds the normal cycle time, CPU 202 decides that the die casting machine 100 is operating abnormally. CPU 202 generates an interrupt signal and it decides that die casting machine 100 is stopped. An alarm signal is generated via PIO 208 and is displayed on panel 300. If the operator of the die casting machine 100 requests to print the alarm signal on printer 218, a message is available to type on printer 218. After generating the alarm message, CPU 202 stops the monitoring of the operation cycle time.

As previously stated, before die casting machine 100 is operated, the operator sets, using waste shot condition setting unit 10, data for controlling how die casting machine 100 carries out waste shot mode operation. These conditions, previously set and stored in memory, are used to automatically control waste shot mode operation after die casting machine 100 has been stopped.

FIG. 4 shows one example of the setting of control conditions for a waste shot. As shown in FIG. 4, the control condition includes "number of waste shots," "ON/OFF of low speed injection process," "ON/OFF of high speed injection process and "intensification". The program in the example of FIG. 4 has four low speed injection processes, it does not have high speed injection process and it does not have an intensification processes.

Another example of control condition is shown in FIG. 5. There are five (5) high speed injection processes in the waste shot. There is no low speed injection and no intensification process in this waste shot.

When die casting machine 100 is restarted, the operator confirms the message of abnormality which is displayed and/or printed by printer 218. After the confirmation, the operator presses a [restart] push button switch which is set on operation panel 300. CPU 202 starts controlling die casting machine 100 in accordance with its waste shot control program stored in ROM 210 based on the data stored in RAM 212 to control this operation. CPU 202 controls the die casting machine 100 using the waste shot control program and various data for the waste shot control is output to PIO 208 via bus line 216.

If the "HIGH SPEED" switch or "Intensification" switch is not turned off, the operation of the die casting machine 100 is automatically shifted to a normal shot mode operation after the waste shot has been completed.

As described above, when the operator stops and restarts the die casting machine, for example, during a lunch break, the operator need only depress the restart push button switch. The apparatus of the present invention automatically operates the die casting machine 100 in waste shot mode in accordance with the predetermined conditions already stored in memory, and then controls the die casting machine so as to operate in normal shot mode. This results in increased efficiency over previously known techniques for controlling die casting machine 100. An added benefit is that the number of bad products produced by controlling die casting machine 100 in accordance with this invention is reduced with respect to previous control techniques.

Although in the embodiment described above the cycle time is monitored as a period from a die clamping process to a spray process, other periods may be used, such as a period from charging process to spray process or form injection process to spray process and the like.

Furthermore, when a metal mold is changed and another metal mold is used, the operator can select data defining waste shot mode operation from RAM 212 for the new mold. Once data for a given mold has been entered, it can be recalled without the need to re-enter it. This also increases efficiency.

Another embodiment of the present invention will now be described In this embodiment, it is mold temperature that is monitored during normal shot mode operation. During normal shot operation molten metal is continuously injected into a cavity of a metal mold. If all is going well, the mold temperature will rise above and stay above a predetermined value. If, during normal shot mode operation (not when the mold is being changed), the metal mold temperature drops below the predetermined value, it is indicative of an abnormality.

Upon the indication of abnormality, the operator stops the die casting machine and determines the problem. After the problem has been corrected, the operator restarts the machine and operates in waste shot mode.

During normal mode operation, when the metal mold temperature goes below the predetermined value, ADC 206 sends the appropriate signal to CPU 202 which determines that the die casting machine 100 is operating abnormally. The predetermined temperature value had previously been set by the operator using key board 204 and stored into RAM 202. If the temperature of the metal mold goes below this predetermined value during normal shot process, CPU 202 causes an alarm to be displayed by panel 300. CPU 202 also outputs an alarm message to printer 218 and then enters a wait status for a new command for restart.

When the restart command is issued by the operator pressing a restart push button switch on panel 300, the operator selects a pattern number for the waste shot to be next carried out. CPU 202 controls the waste shot according to the selected pattern.

Although the embodiments described above relate only to the determination of a cycle time and the measurement of mold temperature, other parameters could be monitored. In fact, any combination of parameters could be monitored to indicate an abnormally operating die casting machine 100.

Although the speed of the low speed injection is used as the speed for a waste shot in the embodiments described above, another type of control could be used, in which the speed for a waste shot is programmed. Various speed values are used in this embodiment.

An example of a waste shot program for this case is shown in FIG. 6. The speed of low speed injection is 200 mm/second in the example shown. This injection speed could be set to any desired speed by manipulating panel 300 and sending signals via PIO 208. CPU 202 uses this value as a speed in the waste shot control at low speed injection process. A high speed injection value is also programmable in this embodiment as shown in FIG. 6 if the operator selects the "ON" option for "HIGH SPEED INJECTION" The intensification pressure value is programmable if operator selects the "ON" option for the "INTENSIFICATION PROCESS".

Although the detection of cycle time and metal mold temperature have been described above, various other parameters could be used to define waste shot mode operation. Such parameters include, but are not limited to the following: a pressure value of injection, stroke length of an injection plunger, speed of molten metal.

The waste shot control arrangements described above can be applied to various types of die casting machines, including but not limited to hot chamber die casting machines, cold chamber die casting machines and others.

According to this invention, waste shot operation can be automatically controlled without any intervention by the operator, once data has been entered and stored. Moreover, waste shots which would normally come about because of improper operator judgments are prevented because of the more automatic nature of operation, namely the operation in waste shot mode according to predetermined criteria previously programmed. This results in an improvement of the error ratio of die casting products.

In summary , this invention provides waste shot control for a die casting machine that improves over the prior art. Based on various detected conditions, the die casting machine is automatically operated in waste shot mode and then in normal shot mode.

What is claimed is:

1. An apparatus for controlling a waste shot of a die casting machine, the apparatus comprising:

setting means for inputting waste shot mode conditions defining waste shot mode operation of the die casting machine;

memory means for storing the waste shot mode conditions;

monitoring condition setting means for inputting conditions for monitoring normal shot mode operation of the die casting machine;

detecting means for detecting process data indicative of operation of the die casting machine during normal shot mode operation;

said detecting means comprising:

means for comparing the process data with the conditions previously input via the monitoring condition setting means and determining whether the die casting machine is operating normally, and if not, providing an indication of abnormality; and control means for a) stopping normal shot mode operation responsive to a determination of abnormality, and b) controlling the die casting machine, responsive to a restart signal, to operate in waste shot mode in accordance with waste shot conditions retrieved from the memory means.

2. An apparatus according to claim 1, wherein the detecting means includes:

means for detecting a temperature of a metal mold of the die casting machine and providing data indicative thereof;

analog digital convertor means for providing a signal indicative of temperature detected by the detecting means.

3. An apparatus according to claim 2, wherein the temperature detecting means includes a thermocouple which is attached to the metal mold.

4. An apparatus according to claim 1, wherein the detecting means includes a timer means for counting a cycle time for a process of the die casting machine.

5. An apparatus according to claim 4, wherein the timer means includes:

a pulse generator which continually generates pulses; and an interruption circuit which interrupts the control means.

6. An apparatus according to claim 1, wherein the setting means includes a key board for inputting the waste shot conditions.

7. An apparatus according to claim 1, wherein the monitoring condition setting means includes a key board for inputting the monitoring conditions.

8. An apparatus according to claim 1, wherein the memory means includes a random access memory.

9. An apparatus according to claim 1, further comprising:

a printer for printing a message indicating an abnormality detected by the detecting means.

10. An apparatus according to claim 1, wherein the control means includes:

an input means for inputting a start signal and a restart signal;

an output means for displaying data indicative of the condition of the waste shot and the condition of the die casting machine;

a CPU for controlling the input means and the output means for the waste shot, and a read only memory means for storing a control program for the CPU.

11. An apparatus according to claim 10, wherein the output means includes a CRT display.

12. A method for controlling a die casting machine operable in waste shot and normal modes, comprising the steps of:

setting and storing in a memory data defining waste shot mode and normal shot mode operations of the die casting machine;

operating the die casting machine in normal shot mode;

determining whether the die casting machine is operating in accordance with the data defining normal shot mode operation;

in the event that the die casting machine is not operating in accordance with the data defining normal shot mode operation, stopping- -operation of the die casting machine; and if the die casting machine has been stopped, starting operation of the die casting machine and automatically operating it in waste shot mode in accordance with data previously stored, and then automatically operating it in normal shot mode in accordance with data previously stored.

13. A method according to claim 12, wherein the detecting- step includes the step of monitoring temperature of the metal mold used in the die casting machine.

14. A method according to claim 12, wherein the detecting step includes the step of monitoring a cycle time of the casting process for the die casting machine.

15. A method according to claim 12, wherein the detecting step includes the step of providing an alarm message indicating abnormal operation.

16. A method according to claim 12, wherein the starting step includes the step of responding to a restarting signal to start operating the die casting machine in waste shot mode.

17. A method according to claim 12, wherein the setting step includes the steps of:

setting a pattern number of the waste shot,. a number of waste shot, and an existence of a casting process of a die casting machine.

18. A method according to claim 16, wherein the casting process includes a low speed injection process, a high speed injection process and an intensification process.

* * * * *